United States Patent [19]

Kobler et al.

[11] Patent Number: 4,840,365

[45] Date of Patent: Jun. 20, 1989

[54] APPARATUS FOR RECEIVING AND TRANSPORTING FOLDED SHEETS OR SHEET PACKAGES

[75] Inventors: Ingo Kobler, Anhausen; Godber Petersen, Augsburg, all of Fed. Rep. of Germany

[73] Assignee: MAN ROLAND Druckmashinen AG, Offenbach am Main, Fed. Rep. of Germany

[21] Appl. No.: 56,786

[22] Filed: May 29, 1987

[30] Foreign Application Priority Data

Jun. 28, 1986 [DE] Fed. Rep. of Germany ..... 3621832

[51] Int. Cl.[4] ..... B65H 39/02

[52] U.S. Cl. ..... 270/54; 270/55; 270/57; 270/58

[58] Field of Search ..... 270/54, 55, 56, 57, 270/58; 198/644, 626, 424; 271/204, 206

[56] References Cited

U.S. PATENT DOCUMENTS

| | | | |
|---|---|---|---|
| 3,122,362 | 2/1964 | Vollrath et al. | 270/58 |
| 4,046,367 | 9/1977 | Merker et al. | 270/55 |
| 4,465,269 | 8/1984 | Petersen | 270/47 |
| 4,605,212 | 8/1986 | Kobler | 270/54 |
| 4,605,213 | 8/1986 | Hechler | 270/55 |
| 4,723,770 | 2/1988 | Seidel et al. | 270/55 |

FOREIGN PATENT DOCUMENTS

| | | |
|---|---|---|
| 278133 | 9/1914 | Fed. Rep. of Germany . |
| 2140772 | 7/1974 | Fed. Rep. of Germany . |

*Primary Examiner*—Robert E. Garrett
*Assistant Examiner*—Therese M. Newholm
*Attorney, Agent, or Firm*—Frishauf, Holtz, Goodman & Woodward

[57] ABSTRACT

To provide for a space-saving, yet high-capacity storage system for sheet elements, for example folded printed paper sheets or the like, a plurality of segments (6) are slidable along a guide track. The segments are interconnected, for example by welding, hinges or the like, in zig-zag or accordeon pleat form. When compressed, the structure can be empty and any number of segments can be taken from an empty storage region, transported to a loading/unloading/mixing region for insertion, removal, or interleaving of sheet elements, while the segments are in expanded position; and then, again, compressed so that sheet elements or folded sheets will continue to be carried in the structure formed by the segments, with little space required. For interleaving or intermixing of sheets, folded or single sheet elements, two such zig-zag carrier structures can be located adjacent each other or above each other, and by spreading apart the segments which may be in U-shape, two paired lateral elements supported on divergent rails or the rail, permit dropping of sheets or sheet elements from an upper segmental array into a lower one or, if located adjacent each other, permit gripping of sheet elements in one array and lateral transport by grippers to an adjacent one.

29 Claims, 8 Drawing Sheets

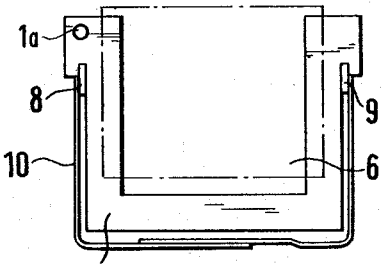
FIG.1
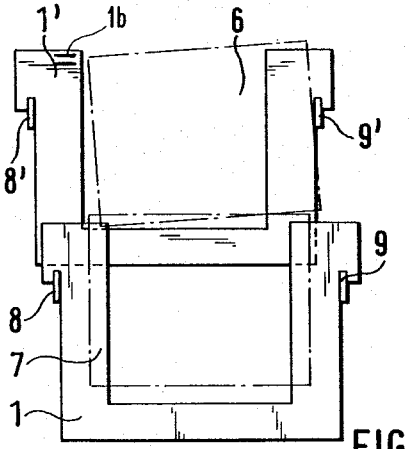
FIG.2
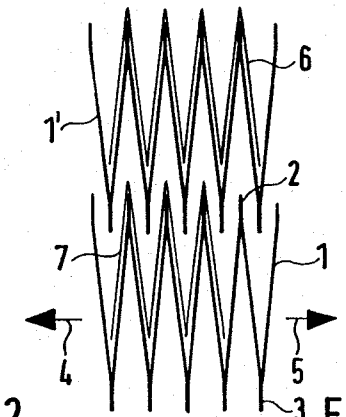
FIG.3
FIG.4
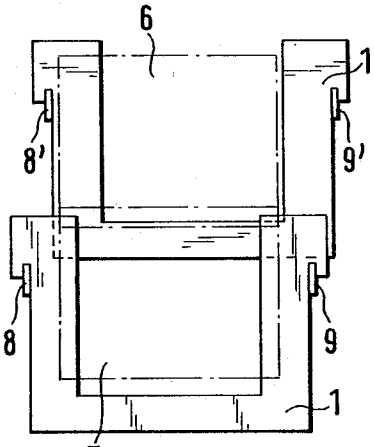
FIG.5
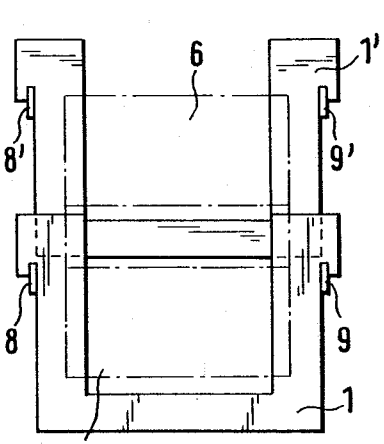
FIG.6
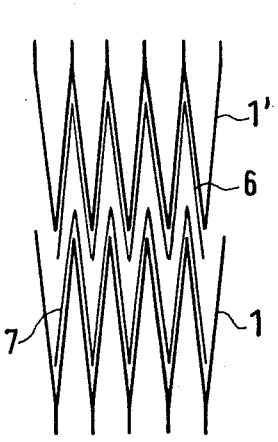
FIG.7

APPARATUS FOR RECEIVING AND TRANSPORTING FOLDED SHEETS OR SHEET PACKAGES

Reference to related applications, assigned to the assignee of the present invention, the disclosure of which is hereby incorporated by reference:

U.S. Ser. No. 07/060,764, filed June 10, 1987, pending Kobler et al;

U.S. Ser. No. 07/056,857, filed May 29, 1987, pending Kobler et al;

U.S. Ser. No. 07/056,787, filed May 29, 1987, Petersen now U.S. Pat. 4,775,136.

U.S. Pat. No. 4,465,269, Petersen; U.S. Pat. No. 4,605,213, Hechler; U.S. Pat. No. 4,605,212, Kobler, all assigned to the assignee of the present application, the disclosures of which are hereby incorporated by reference.

The present invention relates to an apparatus to transport folded sheets or sheet packages also referred to as folded products, and more particularly to folded paper substrates, received for example from a printing machine. When reference is made hereinafter and in the claims to "sheet", it is to be understood that the singular form is used merely for convenience and is to include packages of sheets, for example numerous folded sheets, for instance newspapers.

BACKGROUND

It is generally known, and frequently required in the printing and paper handling industry, to place inserts into folded sheets or sheet packages. Frequently, newspapers, periodicals and the like have inserts added thereto, for example special advertising sections, special regional sections, prospectus material and the like. It has been proposed to roll off folded products received from a storage drum, provide an opening drum or cylinder element and to open the folded products on the storage drum thereon in order to apply the inserts. This arrangement requires substantial space and apparatus components. Opening already folded products is complicated and requires an overhang or overlap, increasing paper use.

U.S. Pat. No. 4,605,212, Kobler, and U.S. Pat. No. 4,605,213, Hechler, both assigned to the assignee of the present application, describe arrangements in which folded products are positioned by means of carrier rods engaging beneath the fold line or spine of the folded products. The carrier rods are coupled to transport arrangements, to guide and transport the folded products. Inserts can be placed by interengagement of folded products, while the folded products hang from the carrier rods, with folded sheet elements spread apart. The apparatus works well, however requires a fair amount of space.

THE INVENTION

It is an object to provide a receiving and transporting apparatus for folded sheets or folded substrate products which permits acceptance and guidance of folded products or adjacently positioned sheets in such a manner that insert sheets or other folded products can be inserted between the sheet elements of folded products or of adjacent sheets; and also to permit storage of fold products in compact form in reduced space without leaving the storage apparatus. The folded products or adjacent sheets should not require any overhang or overfold, or additional apparatus.

Briefly, a plurality of plate-like segments are provided, connected in zig-zag or accordion or bellows form, and capable of being compressed towards each other or, respectively, expanded or drawn apart. A support element supports the segments for movement between compressed or expanded position. The segments, preferably, form an elastic and elastically deflectable sheet holding structure to receive folded sheets or adjacently positioned individual sheets, which can be inserted in the structure. A spreader element can be engaged between individual sheets or sheet elements to spread them apart for insertion of insert sheets or folded sheets upon spreading apart of the segments.

The invention is applicable not only to folded sheets, or packages of sheets, but also to inserting substrate elements between two individual sheets which, for example, may be placed between the segments, connected or unconnected from each other; in other words, it is not necessary that the sheet elements— in which the term "sheet" may be a package of sheets, as noted above— are derived from a folded sheet; the sheet elements or packages of sheet elements may be separate, or connected at one side which would correspond to the position of the fold or spine or crease of a folded sheet. Reference is made hereinafter to "folded sheets" and "sheet elements". It is to be understood that the sheet elements usually are part of a folded sheet, connected together by a fold or crease line, although they need not necessarily be so connected.

DRAWINGS

FIG. 1 is a general schematic end view of a segment on a carrier holder to receive folded sheets;

FIGS. 2, 4, 5 and 6 are end views showing arrangements to place an insert between sheet elements;

FIGS. 3 and 7 are side views of insertion arrangements, illustrating steps upon placement of insert sheets between sheet elements;

DETAILED DESCRIPTION

Figure 28:
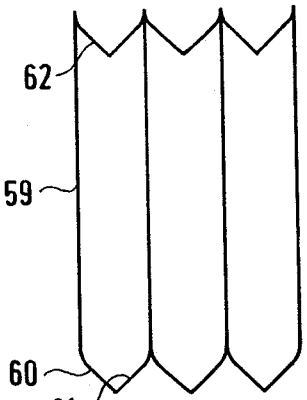
FIG. 28 is a view similar to FIG. 27, in which the accordion-pleat connection is formed by V-connecting sections
Figure 27:
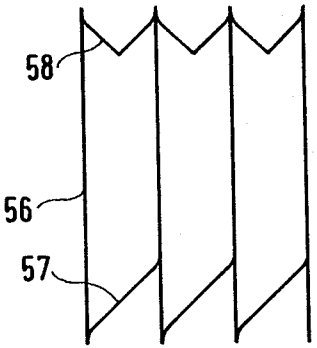
FIG. 27 is a schematic side view of another arrangement of segments in which the segments are located next to each other, with accordion-pleat connection.

The segments 1 are preferably formed by thin elastic plate-like or sheet-like structures, for example of hardened steel; they may, however, also be made of plastic, cardboard, or other elastic material having sufficient stability along the major plane of the sheets, and are of a material so that they can be connected together in suitable manner, to form a zig-zag arrangement (see FIGS. 3 and 7, for example), or to be connected in accordion-pleat form (FIGS. 27, 28). The materials should be capable of being connected, for example by spot-welding metal sheets together, or by use of hinges. For example, piano hinges or similar simple structures may be used in order to assemble the segmental plate elements 1 into the zig-zag form or the accordion-pleat form, as shown in the drawings, so that the segmental elements can be expanded or compressed, to form pockets when expanded and a compact structure when compressed. If joints in the form of hinges are used, it is not then necessary that the segments 1 themselves be elastic. If made of plastic, "living hinges" can be used to connect plastic sheet/or rod elements together. To maintain a distinction between the folded sheets or parallel sheets and the segments 1, the segments will be referred to as plate-like elements, which are best seen in FIGS. 1–7. At the upper and lower points where the plate-like elements touch, they are connected at upper and lower engagement or touching regions 2, 3 (FIG. 3). The segmental plate elements can be connected near their terminal edges along adjacent major planes, see FIGS. 3, 4, 7, 15 and 18. The plate elements 1 can be connected by spot-welding; or, in dependence on the material, for example by hinges, living hinges, or the like, or by interengaging loops or in any other suitable manner. The segments 1 thus will form a segment assembly defining a carrier structure, in essentially zig-zag arrangement as seen in FIGS. 3 and 7, such that the segmental plate elements 1 can be elastically expanded in the direction of the arrows 4, 5 (FIG. 3) or elastically compressed against each other counter the direction of the arrows 4, 5, and thus form a compact unit. A group of segments forms an array or assembly. The segments of the array or assembly are so connected that, upon application of force to a segment, subsequent segments will elastically be pulled longitudinally in a direction transverse to the major planes of the plate-like elements 1, or compressed together, respectively, in accordion form, see FIG. 29.

Figure 29:
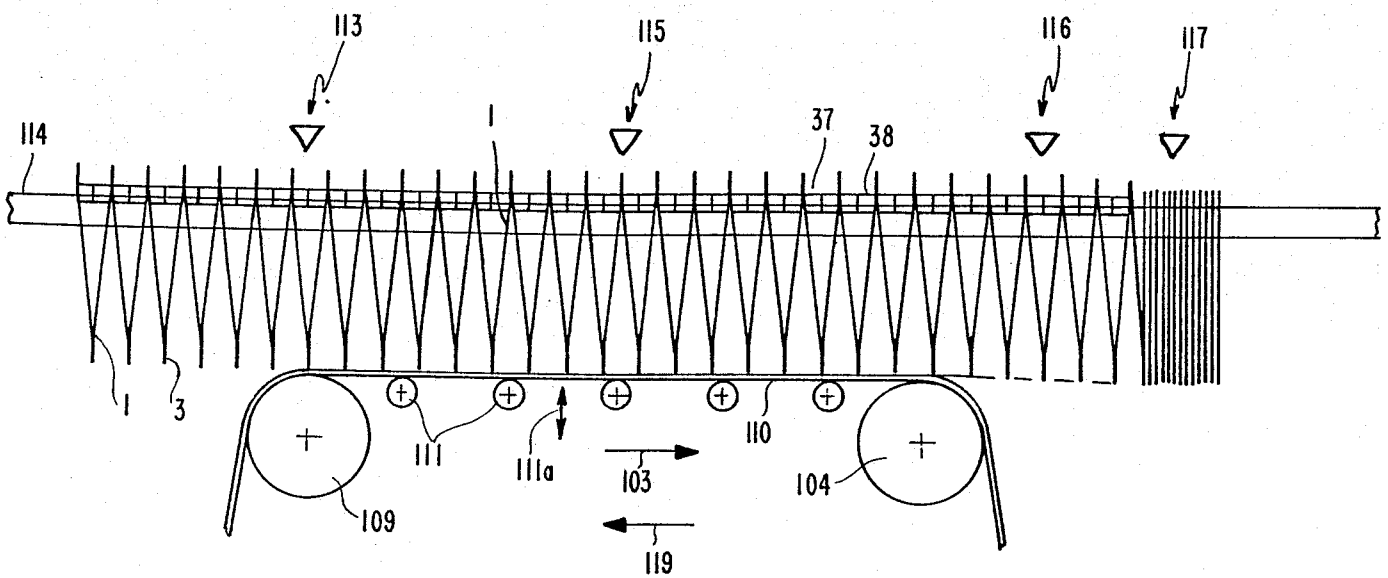
FIG. 29 shows elastic expansion and compression for an assembly or array.

FIG. 29 shows the segments 1, in a group or array, being removed from or supplied to a storage region 117. A belt, shown only schematically at 110, engages the lower engagement region 3. The belt is guided over deflection rollers 104, 109. When the belt moves in the direction of the arrow 103, the previously expanded segments 1 are resiliently compressed in a direction towards the storage region 17. If the direction of movement of the belt 110 is reversed, as shown by the arrow 119, segments 1 will be withdrawn from the storage region 117, resiliently expand in the region 116, and be transported along guide rails 114 through regions 115 and 113. To permit selective engagement of the belt 110 with the segments 1, the belt can be lifted against the touching regions 3 by rollers 111, as schematically indicated by the arrow 111*a*. The belt 110, thus, applies a force on the segments of the array or assembly, which, then, causes their resilient expansion or compression, respectively.

Any suitable number of plate-like segments 1 can be joined together in order to form a carrier system of defined length; because of the flexibility, the carrier system can also be formed in an endless chain, by connecting a last segment to a first one, located in a closed loop, for example of essentially top view. As best seen in FIGS. 1 and 3, the individual segments are so shaped that sheets of paper or folded products 6, 7 can be carried in pockets defined by the segments, whether the segments are opened or closed. If the structure or the carrier is expanded, the sheet elements of the folded sheets will open at predetermined positions; upon compression, for example for compact storage, the pockets will close.

In accordance with a feature of the invention, the plate-like segments are so shaped that they can be supported on a support cassette or holder or bin 10 which defines two upper rail sections 8, 9, regardless of whether the segments are expanded or compressed.

When a predetermined length of an assembly or array of segments has been reached, it is desirable to provide suitable transport arrangements. Suitable transport arrangements may operate intermittently or continuously, and may be in the form of transport belts, gear belts or the like. A particularly suitable transport arrangement is described in the copending application U.S. Ser. No. 07/060,764, filed June 10, 1987, Kobler et al.

The general shape of the segments 1 is of essentially U form—as best seen in FIGS. 1 and 2. The legs of the segments 1 are formed with externally laterally projecting portions which engage in or overlap the rails 8, 9 at the upper side of the holding bins 10. The folded sheet carrier can be moved along these rails. Two rows of such zig-zag segments can be placed above each other, as seen in FIGS. 2 through 7. For simplicity, the upper rows have been given the same reference numerals as the lower ones, with prime notation. Thus, folded sheet products 6 which, for example, are stored on the segments 1', can be inserted in the sheets stored on segments 1. A suitable sequence of steps is this: First, the folded products 6 in segments 1' are shifted or canted, as seen in FIG. 2, to insert the edges of folded products 6 between the upper edges of the folded sheets 7 in the lower group of segments 1. The sheets 6 can be canted in either direction. Then, the upper segments 1' are shifted laterally—see FIG. 4— so that the upper sheets 6 will slide off, first from the left and then from the right leg of the upper segment 1', to fit on the lower sheet 7 and to fall thereinto. FIGS. 3 to 7 illustrate the sequence of steps schematically. For ease of illustration, the sheets 6, 7 are delimited by chain-broken lines.

FIG. 3 illustrates the position of a sheet 6 prior to canting, in side view; FIG. 7 is a side view of the position of the sheets 6 shown in plan view in FIG. 6.

Figure 18:
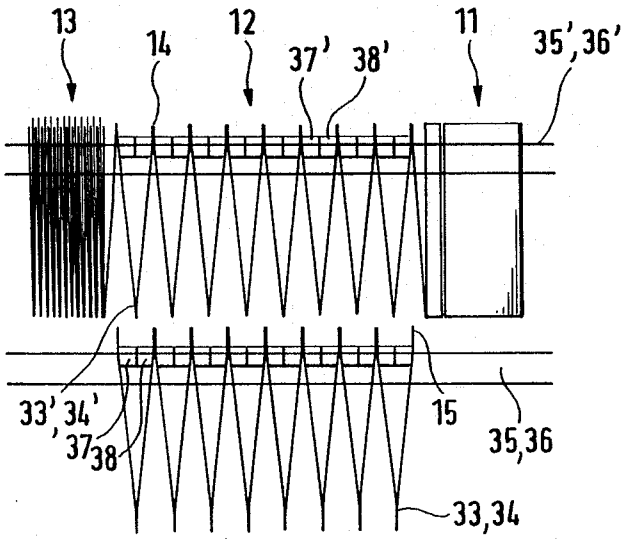
FIG. 18 illustrates, schematically, a side view of a storage, insertion and mixing station, utilizing the segments of any one of the preceding Figures.

A group or an array of segments forming a complete holder assembly is shown in FIG. 18. In region 11, the holder 10 has an empty region, from which a group of segments have just been removed. From the empty region 11, the zig-zag shaped segments 1 are guided on rails 8, 9 or rails 35, 36 (FIG. 16), to be pulled out from the region 11 and expanded in order to form an unloading/loading region 12, which may also be termed a mixing region, to mix the sheets or sheet elements of one group of segments with those of another group of segments. Thereafter, the loaded segments 1 shown in the illustration of FIG. 18—are compressed and stored in a compression or storage region 13. The storage region 13 may be retained within an individual bin 10, or the bin 10 may extend over the entire range. As can be seen, the storage is space-saving and reliable.

Sheets 14 can be inserted in the segments from above in the loading/unloading and mixing range 12 in spread-apart form, for example as described in U.S. Pat. No. 4,605,213, Hechler, assigned to the assignee of the present application; thereafter, inserts 15 can be added, delivered from a further and separate system, for example as described in the referenced U.S. Pat. No. 4,605,213; thereafter, the combined sheets are stored in the storage region 13.

Figure 11:
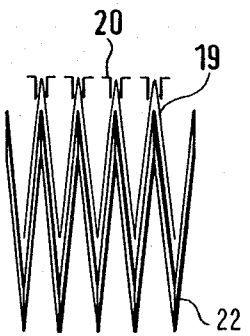
FIG. 11 is a side view, schematically illustrating transfer, as shown in end view in FIG. 9.
Figure 9:
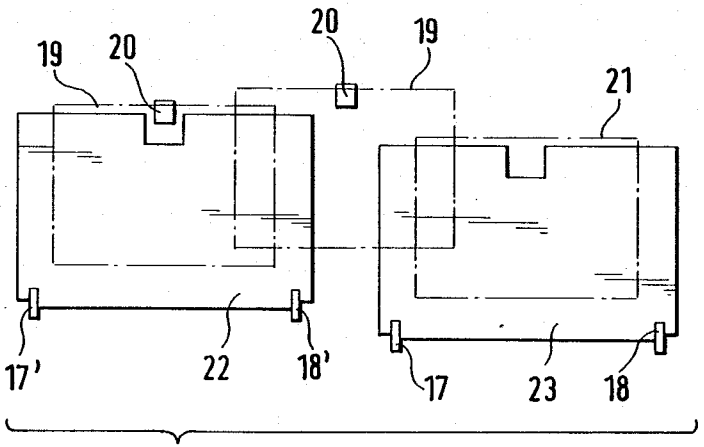
FIG. 9 illustrates transfer of a folded sheet and its sheet elements between adjacently positioned segments.
Figure 8:
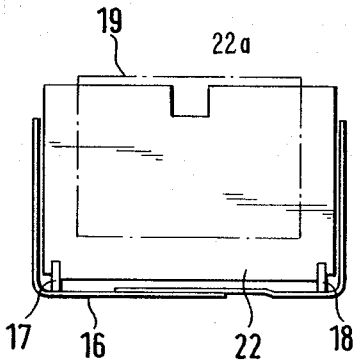
FIG. 8 is an end view illustrating another embodiment of a segment.

FIGS. 8, 9 and 11 illustrate a further embodiment of the segments which, in this illustration, preferably are made of elastic sheet-metal elements. For ease of handling, they are guided on rails 17, 18 by being introduced into a bin 16, on which the rails are secured. The segments, of course, can be easily removed from the bin. The plate-like segments 22 are formed with a cut-out 22*a* in the upper region, of sufficient size and dimension to permit introduction of a gripper 20 thereinto, to grip the upper edge of a sheet 19. Grippers 20, suitably supported on a gripper arm or rail, can pick up the sheets 19 and transfer the sheets into another segmental holding structure, preferably located adjacent to and somewhat below the holding structure formed by the segments 22. The segments 23 adjacent the segments 22 can all be alike. The grippers 20 grip the sheets 19, slightly lift them, transport them laterally, and drop them into the pockets defined by the segments 23 by movement of the grippers 20 towards the right, as schematically shown in FIG. 9. When the sheets 19 are properly positioned, the grippers 20 release and withdraw to repeat the steps with another group of sheets 19. The sheets 19, being introduced above other sheets already between the segments 23, and just before being released from the grippers 20, are shown in side view in FIG. 11.

Figure 14:
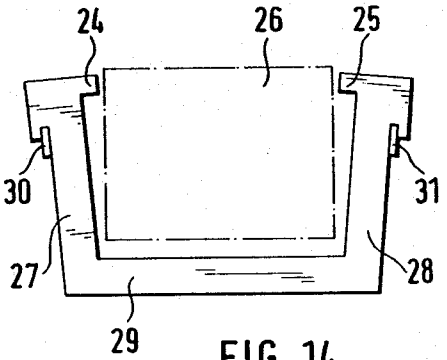
FIGS. 12 through 14 illustrate yet another arrangement of the segments.
Figure 13:
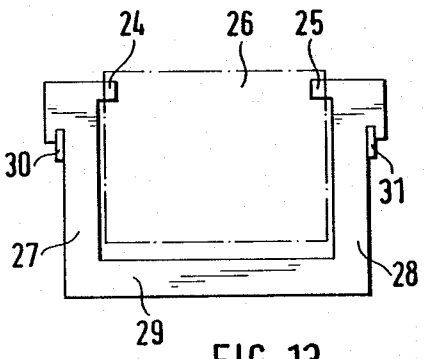
Figure 15:
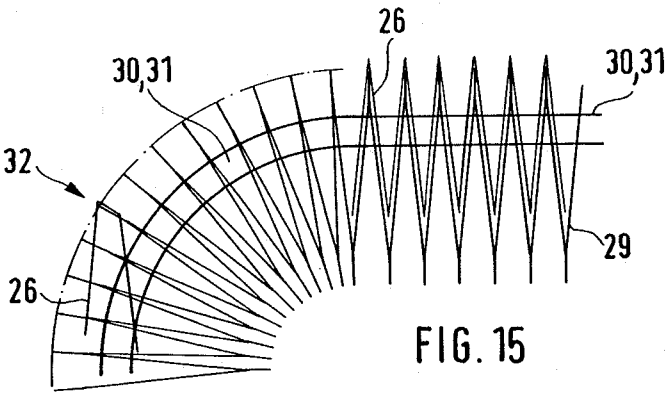
FIG. 15 is a side view of transport of the segments of FIGS. 12 to 14.

FIGS. 12 through 15 illustrate another arrangement of the segments; they are, again, generally U-shaped to form a zig-zag carrier structure. The carrier structure is stored in a cassette or holder bin 10 (FIG. 12) in compressed form. The segments 29 are formed with leg portions 27, 28 which, at their upper ends, have inwardly directed projections 24, 25 which engage beneath the fold or spine or crease of folded sheets 26. The legs 27, 28 are guided on rails 30, 31 which, laterally, are placed at respectively different distance from each other throughout the course of the extent of the rails 30, 31, thus causing the legs 27, 28 to be deflected in the bent or curved region 32 (FIG. 15). In the curved region 32 (FIG. 15), the folded sheets 26 will be spread, while the projections 24, 25 will twist, permitting folded sheets 26 to be released and to drop downwardly, to be placed on some other structure— not shown—for example on a removal transport belt system or the like. Spreading-apart is also possible by lateral twisting of the segments. FIG. 14 illustrates release of the sheets 26 from the spread-apart projections 24, 25 of the segments.

Figure 17:
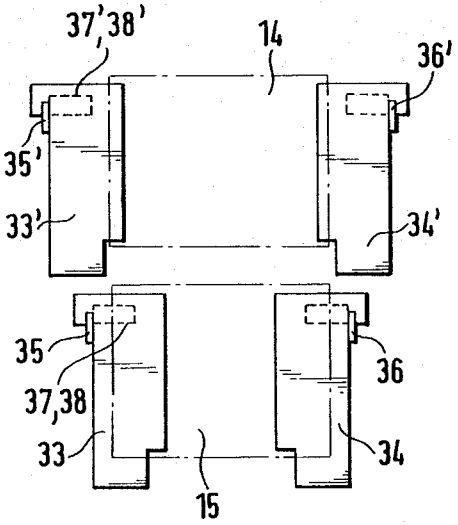
FIGS. 16 and 17 are end views of another form of segments, and illustrating transfer of folded sheets from one segment to another, to permit placement of inserts.
Figure 16:
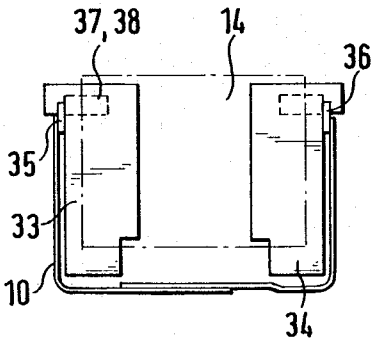
Figure 19:
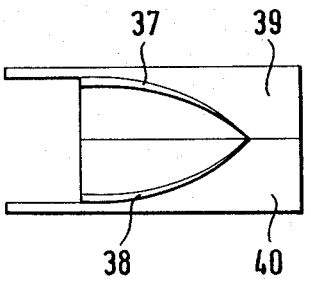
FIG. 19 is a fragmentary top view of the segments of FIGS. 16 and 17.
Figure 20:
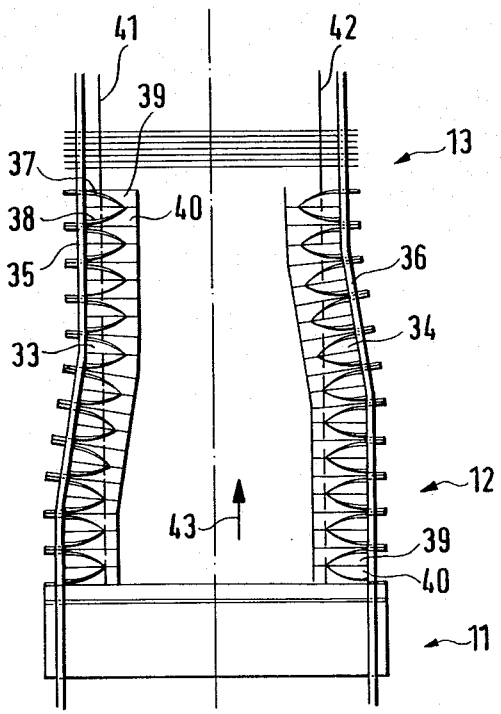
FIG. 20 is a view similar to FIG. 19, to a reduced scale, and showing the transport path of the respective segments.

FIGS. 16 to 20 illustrate arrangements in which the segments 33, 34 are located on rails 35, 36 on holders or bins 10. The segments 33, 34, received from a supply zone 11, can be pulled apart or expanded in a loading-/unloading and mixing region or zone 12, in order to release sheets therein, or receive sheets, for example to release sheets so that they can drop downwardly on further sheets 15—see FIG. 18—and carried on another transport system, for example similar to that of holder 11. Guidance on rails 35, 36 which have respectively different spacing from each other in different locations is desirable. When the spacing between rails 35, 36 is increased, sheets 14 can be released, as described above. The segments are formed in two segment groups, one on either side of the sheets 14, and each defining a zig-zag structure, as best seen in FIGS. 16 and 17. FIG. 19 shows a top view of the connection of two expanded segments 39, 40 connected together by V-shaped elastic holder tongues 37, 38, positioned between two segments. The V-shaped holder tongues are so arranged that when the segments 39, 40 are expanded, the tongues 37, 38 spread and thus cause spreading of sheet elements or sheets 14 located on the V-shaped holder tongues 37, 38. Upon compression of the zig-zag structure, the tongues which, preferably, are made of thin elastic sheet metal and preferably of the same material as the segments 33, 34 themselves, will compress and engage below the spine or fold line or crease of the folded sheets 14. When the rails 35, 36 diverge from each other, that is, in the transition between regions 13 and 12 (FIG. 20), sheets 14 are released and can drop into the zig-zag carrier structures, as seen in FIGS. 17 and 18, from the carrier structures 33', 34' or on sheets 15 located on the carrier structures 33, 34.

Figure 12:
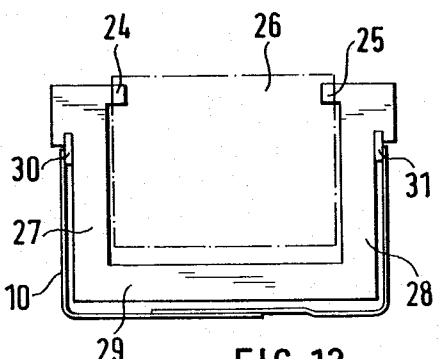
Figure 21:
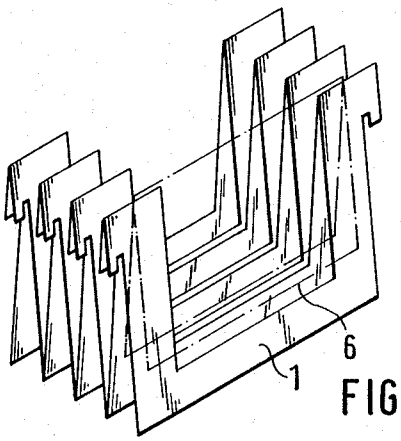
FIGS. 21 through 24 are schematic perspective views of the embodiments in accordance with FIGS. 1, 12, 8, 16, respectively, illustrating the placement of the segments with respect to each other.
Figure 22:
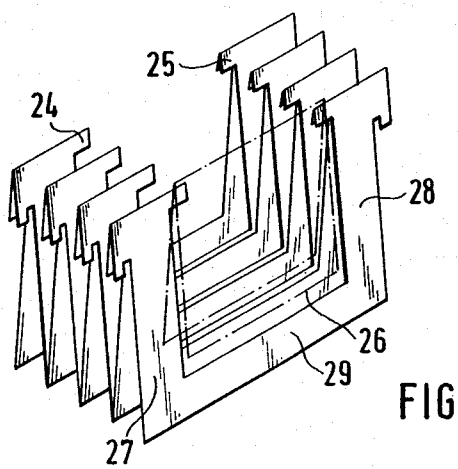
Figure 23:
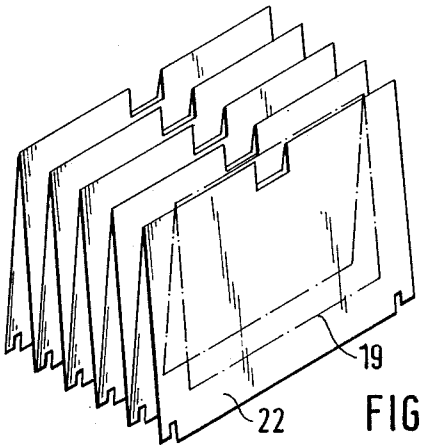
Figure 24:
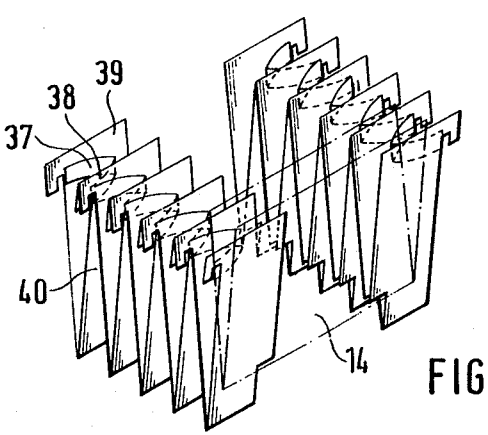
Figure 26A:
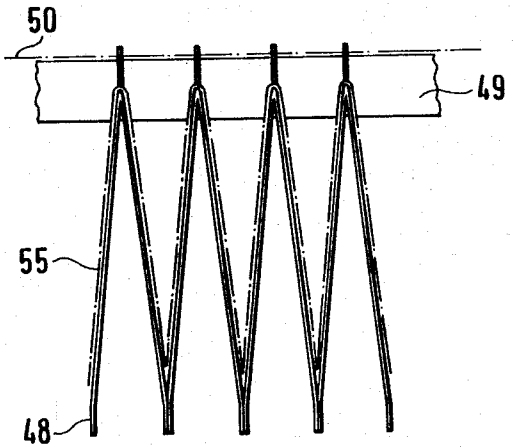
FIG. 26A is a side view of the arrangement of FIG. 26.

The carrier structure 33, 34 may have a path counter that of the structure 33', 34' so that the rails then converge and so that the tongues 37, 38 remain between the sheet elements when the segments are compressed in the region 13. FIGS. 21 through 24 illustrate the segments in perspective form, for ease of visualization, thus FIG. 21 shows the segment of FIG. 1;

FIG. 22 the segment of FIG. 12;

FIG. 23 the segment of FIG. 8;

FIG. 24 the segment of FIGS. 16 and 18.

Figure 10:
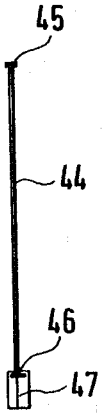
FIG. 10 is an end view of a wire form segment.
Figure 25:
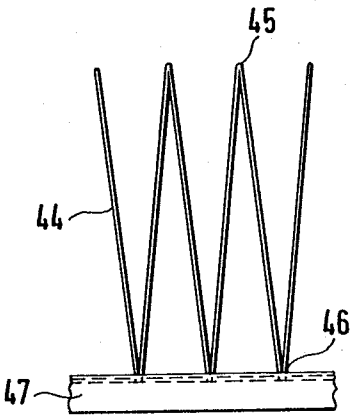
FIG. 25 is a side view of a group of wire form segments, of which one is seen in FIG. 10.

In a suitable constructions, the segments are elastic sheet-metal elements, welded, typically spot-welded together adjacent the upper and lower edges; other arrangements, however, are also suitable. FIG. 25 illustrates formation of the segments of rod material, for example steel rods or steel wires, connected at upper and lower ends 45, 46, for example by welding, and retained in an H-shaped guide structure 47. FIG. 10 is a side view of a rod element 44 in the holding structure 47.

Figure 26:
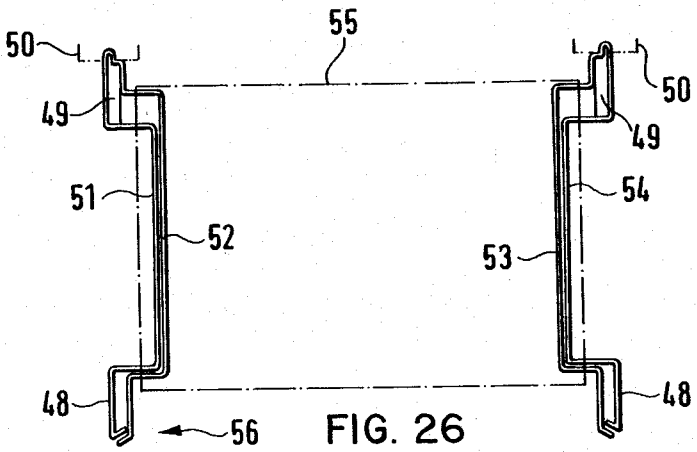
FIG. 26 illustrates another arrangement for holding and transporting segments, in end view.

FIG. 26, at one side, has a structure which is made of a continuous endless elastic wire 48, shaped to form loops which surround a guide and support rail 49. A drive element 50, shown schematically as the end of a gear or sprocket, can engage in a projecting tip formed on the wire loop 48 and positioned above the rail 49. The wire loop then proceeds towards inwardly directed carrier regions 51, 52, 53, 54, to receive sheets 55, and to open and spread apart the sheets. The region 46 illustrates the endless transition of the wire from one segmental unit to the next.

In simple and uncomplicated loading arrangements, the zig-zag carrier structures can be pushed or pulled by hand from a cassette or bin between the cassette or bin in the loading/unloading and mixing range and then, again, manually in a bin for compressed storage. In larger system, an automatic transport arrangement is desirable. Such an automatic transport arrangement is shown, for example, in the copending patent application Ser. No. 07/060,764, filed June 10, 1987, Kobler et al.

FIG. 29 is a fragmentary view of FIG. 1 of this referenced application Ser. No. 07/060,764.

FIGS. 27 and 28 illustrate embodiments in which the segments 56, 59 are located parallel to each other. Carrier projections or tongues 58, 62, of general V-shape, are located between the segments 56, 59, engaging under the fold spine or crease, and spreading the folded elements upon expanding the structures. Two segments, each, are connected in any suitable manner; as shown in FIG. 27, elastic springs 57 connect two segments 56. These springs 57 may, for example, be formed with a slit on one side—not visible in the Figure—in which a pin located on another segment engages. FIG. 28 illustrates a connection formed by elastic V-shaped connecting elements 60, 61, which permit the segments 59 to be spread apart, or compressed against each other. Rather than using segments 60, 61, a hinge joint or the like may be used.

In accordance with a feature of the invention, the segments can be coded, in single segmental units or in groups. Various types of codes can be used. FIG. 1 illustrates a coding arrangement formed by openings punched, for example, in the upper corners of segments 1; FIG. 2 illustrates another arrangement, by applying optically readable bars **1*b* to the segments, for example to be scanned by an optical scanning system; other coding and reading arrangements can be used, for example magnetic codes placed on magnetic strips 1*c*** secured to segments formed of non-magnetic material, for example of bronze, plastic, or the like. Application of such codes and reading of such codes of individual or grouped elements which are transported along a transport path is well known and need not be described in greater detail.

Various changes and modifications may be made, and features described in connection with any one of the embodiments may be used with any of the others, within the scope of the inventive concept.

What is claimed:

1. Apparatus for receiving and transporting folded sheets having a fold line or spine and two essentially parallel sheet elements, which can be spread apart, comprising a plurality of carrier segments (1, 33, 34) defining upper and lower regions and connected alternately at the upper and lower regions to form a segment array or assembly of zig-zag or accordion or bellows pleat form, said segments being connected in such a way that, upon application of a force to a segment longitudinally of the segment array or assembly, subsequent connected segments will be pulled, or pushed elastically to expand or compress accordion-like so that said segments will be, selectively, drawn or spread apart or expanded and compressed towards each other; and a support means (8, 9; 47, 50) supporting said segments for movement between said compressed and expanded positions, said segment array or assembly forming in a direction longitudinally of the array or assembly an elastically expansible or compressible sheet holding structure to receive folded sheets and support said folded sheets for, respectively, expanding or spreading apart and compressing said supported sheets upon expansion and compression, respectively, of the segments.

2. The apparatus of claim 1, wherein (FIGS. 2, 3, 4, 14, 18, 20) two segment arrays are provided, located above each other;

and wherein the segments of at least one of the segment arrays are laterally shiftable or deflectable to provide, upon lateral shifting or deflection of the segments, release of sheet elements on the upper segment array, and for transfer of sheet elements from the segments of the upper segment array to the segments of the lower array.

3. The apparatus of claim 1, wherein (FIGS. 8–11)

two segment arrays are located adjacent each other, in expanded position;

and wherein gripper elements (20) are provided, movable between said adjacent segment arrays for gripping sheets (19) in one of said arrays and movable for transferring said so-gripped sheets to the other array.

4. The apparatus of claim 1, wherein (FIGS. 19, 20) the support means comprises rail elements (35, 36) extending in the direction of a transport path and located adjacent the lateral sides of the segments retaining the sheet elements;

the lateral sides of the segments are, each, formed with holding projections facing each other and supporting said sheet elements thereon;

said transport path including a delivery zone (12) for transferring the sheet elements out from between said segments;

and wherein said rail elements are positioned for increasing the lateral spacing of said rail elements in the delivery zone to such an extent that the sheets (14) can drop from between said segments (39, 40).

5. The apparatus of claim 4, wherein two adjacent arrays of segments are provided, positioned above each other, each supported on respective rail elements, to define a spacing between superposed located segments for holding the sheet elements and, in said delivery zone, said segments being spread apart for permitting the sheet elements of the upper array to drop out from retention by the respective segments into the folded sheets in the segments of the lower array.

6. The apparatus of claim 1, wherein (FIGS. 2–6) the segments are essentially U-shaped, and said folded sheets are suspended from adjacent segments connected at the upper sides thereof;

and wherein said segments are laterally tiltable and shiftable to permit the sheets to drop off and away from suspended position on said segments.

7. The apparatus of claim 1, wherein (FIGS. 12–14) the segments (29) are generally U-shaped and define parallel, upwardly directed legs (27, 28);

inwardly directed projections (24, 25) being formed on said legs, adjacent the upper edges thereof, and adapted for engagement beneath the fold or spine of a folded sheet;

and wherein said segments are capable of being laterally deflected and twisted to permit the folded sheets to become free of said projections and to be thereby released from said segments.

8. The apparatus of claim 7, wherein the support means comprises a guide path (32) engaging the U-shaped legs (27, 28) of the segments, said guide path including a bend or turn for laterally spreading apart the legs (27, 28) of said segments to permit release of folded sheets on the projections.

9. The apparatus of claim 6, wherein the generally U-shaped segments define two essentially parallel upwardly extending legs;

and said support means comprise guide rails (8, 9) laterally engaging the U-shaped legs and supporting said legs on said rails.

10. The apparatus of claim 7, wherein;

said support means comprise guide rails (8, 9) laterally engaging the U-shaped legs and supporting said legs on said rails.

11. The apparatus of claim 1, wherein (FIGS. 8–11) the segments are essentially plate-like elements formed in a central region with a recess;

and gripper means (20) are provided, engageable with said folded sheets and movable in said recess to grip the sheets adjacent said segments, said grippers being movable to move gripped sheets out from between adjacent segments.

12. The apparatus of claim 1, wherein (FIGS. 16, 17, 20) the support means comprises spaced rails (35, 36);

and wherein the segments (33, 34) comprise two-element structures, one each suspended on one of said rails (35, 36).

13. The apparatus of claim 1, wherein (FIGS. 10, 25) the segments (44) comprise rod or bar elements (44).

14. The apparatus of claim 1, wherein the segments comprise thin plate-like elements made of at least one of: thin sheet metal; plastic sheets; cardboard; composition board.

15. The apparatus of claim 1, wherein the segments (1, 44) comprise elastic material;

and wherein the segments are connected to form said zig-zag or accordeon or bellows pleat shape by a bonding connection.

16. The apparatus of claim 1, wherein (FIG. 18);

said support means guides said segments from a compressed state forming an empty-store (11) to a loading/unloading/mixing region (12), wherein said segments are expanded, and are movable along a predetermined path; and, after having been loaded, are again compressed to form a storage array.

17. The apparatus of claim 16, further including holder bins or cassettes (10) retaining the segments in the empty storage region (11) and in the compressed storage region (13).

18. The apparatus of claim 1, wherein (FIGS. 10, 25) the segments (44) comprise rod or bar elements (44);

and wherein the support means comprises a guide element (47, 49) for supporting said rod elements and guiding the rod elements in a predetermined path.

19. The apparatus of claim 1, wherein (FIGS. 17, 19, 20, 24) the support means comprises rail elements (35, 36) extending in the direction of the transport path and located adjacent the lateral side of the segments retaining the sheet elements;

and elastic holders (37, 38) located on the segments and engageable with sheet elements of folded sheets positioned adjacent the segments to retain said sheet elements close to the segments and hence to spread said sheet elements upon spreading apart or expansion of said segments.

20. The apparatus of claim 1, wherein (FIG. 28) the segments (59) are positioned approximately parallel;

and elastic, essentially V-shaped connecting means (60, 61) are provided, connecting the parallel segments for, respectively, expanded or compressed position of the respective segments against each other/or spread apart from each other.

21. The apparatus of claim 1, wherein the segments (59) are formed with essentially V-shaped carrying projections (62) capable of opening and closing for engaging beneath a fold or crease of a folded sheet.

22. The apparatus of claim 1, wherein (FIG. 27) the segments are positioned essentially parallel to each other;

and elastic springs (57) are provided coupled to said segments and connecting the segments (56) to each other while permitting, resiliently, expansion and compression of said segments with respect to each other.

23. The apparatus of claim 22, further including carrying projections (58) located between the segments (56).

24. The apparatus of claim 1, including coding means (1*a*, 1*b*, 1*c*) located on at least some of said segments for coding said segments.

25. The apparatus of claim 1, wherein said carrier segments comprise plate-like elements connected adjacent at least one of the upper and lower regions (2, 3) along the major planes of the elements along a portion of adjacent elements.

26. The apparatus of claim 25, wherein said elements are connected both at the upper (2) and lower (3) adjacent regions, alternately at opposite sides, to adjacent elements.

27. The combination of folded sheets having a fold line or spine and two essentially parallel sheet elements, which can be spread apart with apparatus for receiving and transporting said folded sheets comprising a plurality of carrier segments (1, 33, 34) defining upper and lower regions, said carrier segments being connected alternately at the upper and lower regions to form a segment array or assembly of zig-zag or accordion or bellows pleat form, said segments being capable of being compressed towards each other and selectively drawn or spread apart and expanded, said segments being connected in such a way that, upon application of force to a segment longitudinally of the segment array or assembly, subsequent connected segments will be pulled, or pushed elastically to expand or compress accordion-like so that said segments will be selectively, drawn or spread apart or expanded and compressed towards each other; and said segment array or assembly forming an elastically compressible and expandable sheet holding structure to receive said folded sheets and support said folded sheets between adjacent segments against the immediately adjacent segments for, respectively, expanding and compressing said supported sheets upon expansion and compression, respectively, of the segments in the segment array or assembly.

28. The apparatus of claim 27, wherein said carrier segments comprise plate-like elements connected adjacent at least one of the upper and lower regions (2, 3) along the major planes of the elements along a portion of adjacent elements.

29. The apparatus of claim 28, wherein said carrier segments comprise plate-like elements connected adjacent at least one of the upper and lower regions (2, 3) along the major planes of the elements along a portion of adjacent elements.

* * * * *